United States Patent [19]

Sheldon

[11] 4,076,228

[45] Feb. 28, 1978

[54] KERF CLAMP

[75] Inventor: Harold S. Sheldon, Spokane, Wash.

[73] Assignee: Adjustable Clamp Company, Chicago, Ill.

[21] Appl. No.: 690,649

[22] Filed: May 27, 1976

[51] Int. Cl.[2] ..... B25B 5/14

[52] U.S. Cl. ..... 269/49; 269/243

[58] Field of Search ..... 269/37, 43, 47, 49, 269/243, 289 R; 29/271, 200 P

[56] References Cited

U.S. PATENT DOCUMENTS

| | | | |
|---|---|---|---|
| 2,803,278 | 8/1957 | Dean | 269/243 |
| 3,159,393 | 12/1964 | Villano | 269/49 |

FOREIGN PATENT DOCUMENTS

| | | | |
|---|---|---|---|
| 51,675 | 6/1910 | Switzerland | 269/49 |
| 551,276 | 2/1943 | United Kingdom | 269/49 |

*Primary Examiner*—Robert C. Watson

*Attorney, Agent, or Firm*—Lockwood, Dewey, Zickert & Alex

[57] ABSTRACT

A clamp for securing in proper relationship portions of a piece or sheet of material on opposite sides of a kerf or other separation. The clamp has a base block or part and a pressure block or part the two of which engage a sheet or pieces of material from opposite sides of a kerf therein or line of separation therebetween. The base block carries a blade which projects through the kerf or line of separation into a receiving slot or opening in the pressure block. By tightening fastening means such as a nut threaded on a screw projecting from the kerf blade, the base and pressure blocks may be drawn together in clamping relationship on opposite sides of a kerf or line of separation thereby holding in normal or coplanar relationship the juxtaposed sections separated from each other by the presence of a kerf or other form of separation.

1 Claim, 6 Drawing Figures

KERF CLAMP

This invention relates generally to clamps adapted to hold mating edges of two objects or pieces of material in juxtaposed alignment. The clamps of this invention are useful in connection with sawing pieces of material and particularly in cutting relatively long kerfs in sheets formed of various materials such as plywood, particle board, Celotex sheets, ceiling tile, sheet rock, wallboard, plasterboard, sheet metal, fabrics, Transite, etc. In cross cutting or ripping various materials and particularly materials or objects in sheet form, supporting and holding in proper mating relationship severed pieces or sections so as to avoid binding, sagging, flexing, separating, bending, etc. while sawing or otherwise cutting is often difficult. The pieces severed by a kerf or cut may bind, pinch or twist a saw blade or other cutting tool and tend to droop, bend and separate making the cutting operation awkward, unsafe, slow and difficult. One or more clamps provided by the present invention may be used in various sawing or cutting operations to overcome and eliminate these and other difficulties often encountered in sawing or cutting various materials and objects, particularly materials in sheet form. As will appear below, the clamps of this invention may also be used in holding in juxtaposed alignment mating edges of two different pieces or objects which may not have been formed by being severed or cut from one another.

The clamps provided by the present invention are relatively simple in structure, economical to make and convenient to use. They comprise two clamping members or blocks which when used in a sawing operation engage the piece of material being sawed or cut on opposite sides of a kerf therein. One of the clamping members is a base block or part from which a blade projects at right angles to a planar bearing surface adapted to engage one surface of a sheet or piece of material on opposite sides of a kerf therein. The other member is a pressure block or part which also has a planar bearing surface for engaging the opposite surface of the material also on the opposite side of the kerf. The pressure block or part has an opening for receiving the projecting or distal end portion of the blade. Fastener means are provided for drawing the two clamp blocks or parts together in clamping relationship. The fastener means may take the form of a screw mounted on and projecting axially from the distal end of the blade and a suitable nut threaded thereon which bears directly, or indirectly, against a surface of the pressure block opposite the bearing surface.

The object of the invention, generally stated, is the provision of clamps for holding in alignment the juxtaposed mating edges of two objects or pieces of material.

An important object of the invention is the provision of clamps of the foregoing type for use in assisting workmen such as carpenters in sawing or cutting various materials and objects, particularly materials in sheet form, to avoid the problems that are often encountered in retaining two pieces of material in proper relationship on opposite sides of a kerf or cut.

Additional important objects of the invention will be apparent to those skilled in the art from the following detailed description of the invention taken in connection with the accompanying drawings, wherein.

Figure 1:
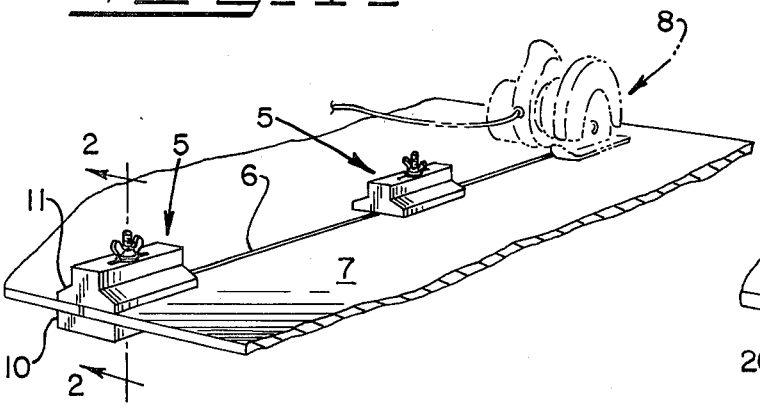
FIG. 1 is a perspective view showing two clamps forming embodiments of this invention in place in a kerf being cut in a sheet of material.

In FIG. 1 two clamps are indicated generally at 5 in place at different locations in a kerf 6 being cut in a sheet of material 7 by a conventional power saw 8 of the type normally used for cross cutting or ripping of various materials.

Each clamp 5 comprises a base block or member 10 and a pressure block or member 11. It will be understood that the blocks 10 and 11 may be formed of wood (solid or laminated), metal (solid or hollow), plastic or various combinations of these materials. A metal insert strip 12 is secured in a rectangular recess 13 formed in the underside of the base block 10. A plurality of screws 14—14 may be used to secure the strip 12 in place. The strip 12 has welded or otherwise secured thereto a perpendicular kerf blade 15 which projects upwardly through a slot 16 formed in the block 10. The pressure block 11 has in the central portion thereof a vertical slot 17 which registers with the slot 16 and receives the upper end of the kerf blade 15. A screw 18 is suitably mounted on the upper or distal end of the blade 15 by means of a pin 20 projecting through the lower slotted end of the screw 18 and a registering aperture in the blade 15. Preferably, the connection between the lower end of the screw 18 and the blade 15 is such as to permit a degree of pivoting action so as to avoid binding action when a wing nut 21 or other form of nut threaded on the score 18 is tightened down against the upper surface of a washer 22 located between the underside of the wing nut 21 and the top surface of the pressure block 11. However, the screw 18 may be mounted on the blade 15 by welding or brazing, if desired.

It will be seen that the upper surface of the base block 10 and the bottom surface of the pressure block 11 are planar surfaces which are adapted to engage the bottom and top surfaces, respectively, of the sheet 7, or other object being cut, from opposite sides of the kerf 6.

The blade 15 should have a thickness such that it fits without binding in the kerf 6. A blade having a thickness of about one-sixteenth inch, a width of about 1¼ inches and a projecting height above the top surface of block 10 of about 1½ inches has been found satisfactory. Clamps 5 having a length of about 4½ inches, a width of about 2½ inches and a height when blocks 10 and 11 engage of about 2¼ inches have been found satisfactory. It will be understood that these dimensions are not critical and that the clamps may have other dimensions.

In use, after the saw 8 or other cutting tool has entered the sheet 7 a sufficient distance to accommodate one of the clamps 5, it is inserted in the end of the kerf and tightened. As the saw 8 continues to lengthen the kerf 6 in the sheet 7, one or more additional clamps 5 may be put in place as may be required to maintain the severed pieces of the sheet 7 in proper relationship on opposite sides of the kerf 6 so that no binding or twisting of the saw occurs and the pieces do not droop, curl, bend, flex or separate, or fall apart when the end of the kerf is reached. Thus, the first clamp 5 that was put in place in the starting end of the kerf 6 is loosened and moved inwardly to adjacent where the saw is temporarily stopped and then a second clamp 5 is put in place at the beginning of the kerf to take the place of the first clamp. This same procedure of advancing one or more clamps 5 and adding another clamp may be repeated as necessary. Usually two or three clamps will suffice for most sawing operations. When the kerf 6 has been completed in the sheet 7, the clamps 5 may be easily removed for further use.

Figure 4:
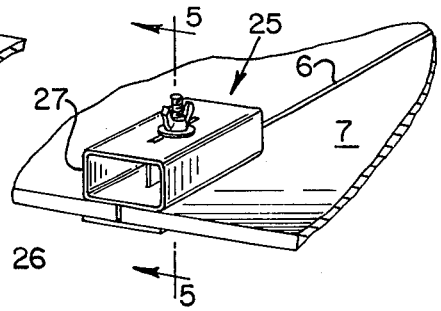
FIG. 4 is a perspective view of another form of clamp in place in a kerf in a sheet of material.
Figure 5:
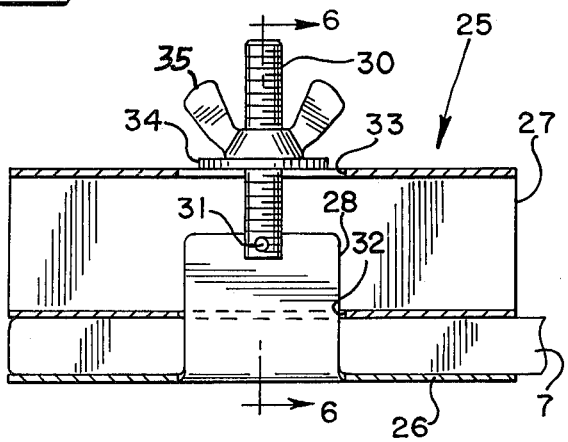
FIG. 5 is a vertical sectional view taken from line 5—5 of FIG. 4.
Figure 6:
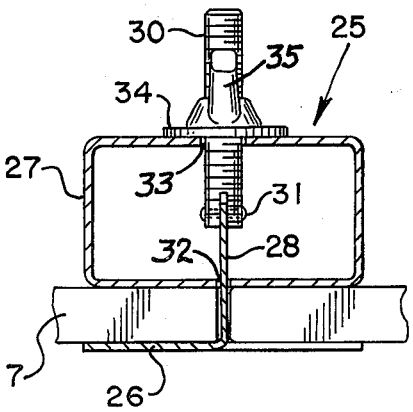
FIG. 6 is a vertical sectional view taken on line 6—6 of FIG. 5.

In FIGS. 4–6 a clamp of different construction is indicated generally at 25 in which the base block or base part 26 is in the form of a rectangular metal stamping and the pressure block or part 27 is in the form of a piece of rectilinear tubing available commercially as a standard shape. A blade 28 formed in the stamping operation projects perpendicularly from the base block member 26 as an integral part thereof. The stamping operation for producing the base block 26 may be performed in known manner with known equipment. The lower end of the clamping screw 30 is slotted so as to straddle the upper edge of the blade 28 and a pin 31 projects through registering apertures in the lower slotted end of the screw 30 and the blade 28 so as to secure these parts together while permitting sufficient pivoting action between the screw and the blade to prevent binding from occurring on tightening the clamp 25. As noted above, the screw 30 may be welded, brazed or otherwise mounted on the blade 28.

The pressure member 27 has a slot opening 32 formed in the bottom thereof for accommodating the blade 28 and an additional opening 33 in the top thereof for accommodating the screw 30. A wing nut 35 or other form of fastener is threaded onto the screw 30 so as to be tightenable against the upper side of a washer 34 which bears against the upper side of the pressure block 27.

Figure 2:
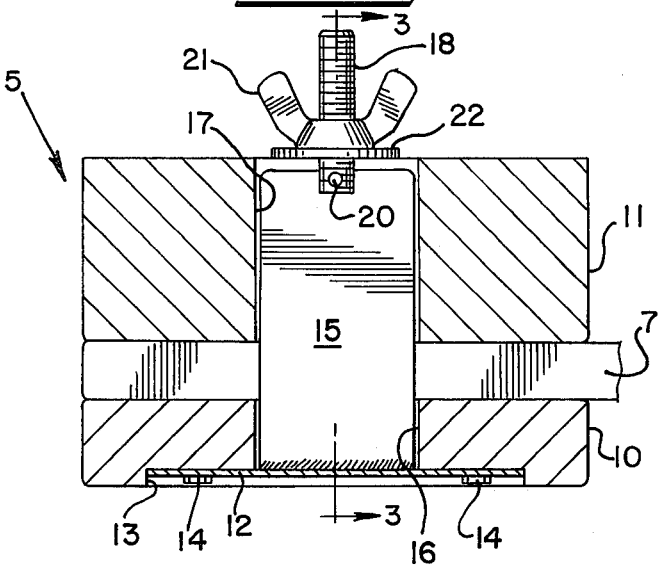
FIG. 2 is a vertical sectional view on enlarged scale taken through one of the clamps on line 2—2 of FIG. 1.
Figure 3:
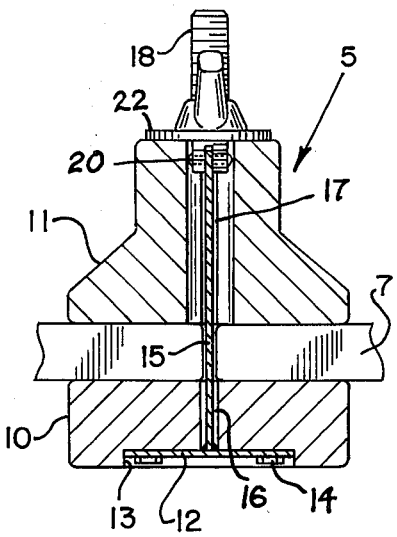
FIG. 3 is a vertical sectional view taken on line 3—3 of FIG. 2.

It will be appreciated that each clamp 25 may be utilized in the same manner as the clamps 5 described above in connection with FIGS. 1–3.

Instead of forming the base 26 and pressure block 27 of clamp 25 from a stamping and tubing, respectively, it will be understood that these parts may be formed as castings or forgings.

While use of the clamps 5 and 25 has been described in connection with cutting a kerf in a piece of sheet material, it will be understood that the clamps have other uses. For example, one or more of clamps 5 or 25 may be used in maintaining in juxtaposed alignment the mating edges of two pieces of sheet metal while the edges are welded, brazed or otherwise secured together. Other uses of the clamps will be apparent and found.

I claim:

1. A kerf clamp comprising, in combination, a clamp base part having an upper horizontal planar work piece engaging surface, a vertical kerf blade permanently rigidly mounted on said clamp base part so as to project perpendicularly upwardly therefrom and through a kerf in a work piece, a screw mounted vertically on the upper distal end of said blade, a clamp tightening nut threaded onto said screw, and a clamp pressure part having a lower horizontal planar work piece engaging surface and having a vertical slot opening therein for recieving said kerf blade extending upwardly from said lower horizontal planar work piece engaging surface and an additional opening for receiving said screw extending downwardly from the top surface of said clamp pressure part, said kerf blade and said vertical slot providing means to align said clamp base and pressure parts with each other and with a kerf, and the mounted end of said screw being slotted and straddling the distal end of said blade and pivotably pinned thereto.

* * * * *